109-49.5 SR
12/2/86 OR 4,625,659

United States Patent [19]

Saelzer

[11] Patent Number: 4,625,659

[45] Date of Patent: Dec. 2, 1986

[54] SECURITY WINDOW OR DOOR

[76] Inventor: Heinrich Saelzer, Industriestrasse 4, 3550 Marburg-Wehrda, Fed. Rep. of Germany

[21] Appl. No.: 767,131

[22] Filed: Aug. 19, 1985

[30] Foreign Application Priority Data

Aug. 31, 1984 [DE] Fed. Rep. of Germany ..... 3432021

[51] Int. Cl.[4] ..... E06B 1/04

[52] U.S. Cl. ..... 109/49.5; 109/58.5; 52/204; 52/207

[58] Field of Search ..... 52/171, 788, 204, 207; 109/49.5, 58.5, 10, 11, 12, 13, 14, 17, 67, 68, 5

[56] References Cited

FOREIGN PATENT DOCUMENTS 3420883 7/1985 Fed. Rep. of Germany .

*Primary Examiner*—Carl D. Friedman
*Attorney, Agent, or Firm*—W. G. Fasse; D. H. Kane, Jr.

[57] ABSTRACT

A bullet- and explosion-proof security structure such as a window or door for closing an opening in the wall of a building or the like has two plate-like panels (5) and (6) which are enclosed in respective frames (2, or 3 and 4) so located that the panels extend in parallel to each other and enclose a chamber or space (13) between them. The frames (2, 3 and 4) are arranged within a soffit (1) surrounding the opening, whereby the outer frame is spaced from the soffit to form a gap (12) between the frame (2) and the soffit (1) for providing a ventilating channel. In order to prevent projectiles from entering through the ventilation gap (12) from the outside of the building into a room in the building, the frames (2, 3 and 4) are covered on their sides facing each other by security members (11 and 33), which are made of bullet-proof material, for example, steel. The securing members extend to cover critical areas of the frames and panel edges near the venting gap (12) and overlap, at least partially, each other.

6 Claims, 4 Drawing Figures

SECURITY WINDOW OR DOOR

FIELD OF THE INVENTION

The invention relates to a security window or a security door having at least two plate-like panels each enclosed by a frame. These panels are arranged at a certain spacing apart from each other and parallel to each other, and are to be connectable to the soffit or opening in a structural wall, so that at least one shank of the frame of the plate-like panel, which is susceptible to attack,is spaced a certain distance away from the soffit or neighboring surface defining the wall opening. Thereby, an opening gap is formed between this frame shank and the soffit. This opening gap vents the space or chamber formed between the two parallel panels with the space outside of the outer panel which is susceptible to attack.

DESCRIPTION OF THE PRIOR ART

A security wall closure of this type is described in German Patent Application No. P 34 20 883.6 disclosing a glazing arrangement for retarding an explosive effect. It is the object of said glazing arrangement to achieve a high retardation of an explosive effect, without requiring the use of glass panels having an extremely high resistant strength. The opening or gap between the soffit frame and the edge of the glass unit on a side susceptible to attack, connects the space between the two glass units with the outside space on the attack susceptible side, whereby pressure equalization is achieved in the event of an explosive blast impact. Thus, the pressure arising in an explosion may still destroy the glazing unit on the outer side, but this reduces the pressure peak so that the maximum pressure cannot become effective on the more inwardly located glass unit or units, since the air within the chamber between the two glass units cannot be compressed to an extent sufficient for damaging the inner glass units, because in effect pressure is vented through the opening gaps around the frame of the outer glazing unit.

The glazing arrangement further makes it possible to construct the inner glazing unit on the side away from the attack susceptible side, as a tiltable or rotatable frame, so that these glazing units may be adjusted, whereby the opening gaps provided for the pressure reduction, may also serve for ventilation of the room protected by the glazing arrangement.

However, the glazing arrangement described in the above mentioned German Patent Application P No. 34 20 883.6 does not offer a sufficient security against firing of projectiles since projectile such as bullets, may penetrate essentially unhindered into the chamber or space between the two glazing units, especially through the area of the gap openings. This is true even if the opening gaps are normally closed or covered by cover members which may be blown off or removed by the blast of an explosion. Besides, the opening gaps must at least remain uncovered during ventilating if the gaps are to also serve the purpose of room ventilation, if the inner glazing unit is mounted in a tiltable or rotatable frame which is adjusted to an open position for the purpose of ventilation. In this case when the hinged window sash of the inner glazing unit is in the open venting position, it does not offer any resistance or protection against a fired projectile. However, a fixed blind frame arranged for cooperation with the hinged window sash provides protection against the penetration of a projectile which has entered through the open gaps into the room to be protected.

OBJECTS OF THE INVENTION

In view of the foregoing it is the aim of the invention to achieve the following objects singly or in combination:

to improve a security window or a security door of the above described type, so that it may achieve a security against fired projectiles and a retardation of explosive effects;

to provide an opening gap in the security window or security door as described above, which serves for a pressure reduction for an explosive blast protection and for allowing room ventilation without impairing the security features;

to provide protection against bullets regardless at which angle a bullet is fired;

to provide the desired protection if the inner frame is hinged for opening and closing and even if the outer frame is also hinged for opening and closing; and to provide the desired protection for fixed windows or doors which are equipped with venting channels forming part of the respective frame structure.

SUMMARY OF THE INVENTION

The above objects have been achieved in a security window or security door of the above described type according to the invention, wherein the frames of the two parallel panels are provided on their inner sides facing each other, with security sectional members, such as bullet-proof sectional armor members. Each frame has at least one such armor member. At least one security member covers the edge of one of the panels and at least one security member covers or overlaps the area of the opening gap. Additionally, both security armor members are so positioned that the member of one of the frames overlaps the security armor member of the other frame.

Due to the use and arrangement of security sectional armor members according to the invention, the immediate area of the opening gaps and an additional endangered edge region of a panel are protected or made secure, while maintaining the desired room ventilation through the opening gap.

According to a further embodiment of the invention, a security sectional armor member may be made of two separate components, whereby the first component is arranged directly on the frame shank for covering the shank while the second component overlaps and is screwed onto the first component there as a glazing strip reaching out over the edge of the panel.

In such an arrangement, the corresponding frame may be made of shanks which, for example, comprise a simple hollow rectangular section with a protruding flange strip cooperating with the above mentioned security component as a glazing strip for fixing the panel.

Preferably the security members of one frame are connected to the security members of the other frame by means of shim or spacer blocks distributed along the length of the frame shank. With this arrangement, for example, the frame facing the side susceptible to attack, hereinafter called the outer side, requires no direct connection with the soffit of the construction opening.

In another embodiment of the invention, at least one frame comprises a window sash and a blind frame, whereby the window sash and the blind frame are covered by overlapping security armor members, and/or a gap between the security armor member of the window sash and the security armor member of the blind frame is covered by the security member of the respective other frame. However, if in certain situations it should be too costly or too complicated that the security member of the window sash and the security member of the blind frame overlap each other, it is also possible to cover the window sash and the blind frame with security members arranged only in one plane. In this manner the gap between these security members may be simply covered by the appropriate arrangement of the security member of the respective other rigid or fixed frame, so that the security against fired projectiles is maintained.

A further embodiment of the invention protects also the soffit area of the structural opening, by covering a blind frame directly connected to the soffit of the structural opening with a security member to which a further security member is connected. The further security member extends or supplements the first mentioned security member as a Z-shaped cross-sectional edge or flange which covers the soffit and the soffit margin area. This additional or further security member preferably has an angle-shaped cross-section. This arrangement achieves an effective protection of the entire frame area against projectiles fired from any desired firing angle.

Yet another embodiment of the invention provides that the platelike panel facing the outer, attack susceptible side is enclosed by a fixed or rigid frame, and the panel facing the inside is enclosed by a movable frame. This movable frame at least comprises a frame shank divided lengthwise by a ventilation slide or the like, whereby the two resulting frame parts are covered by security members of which the neighboring or adjacent edge areas are overlapped by another security member covering the ventilation slide at a spacing.

By protecting the ventilation gap as just described a ventilation airstream may pass through the free gap area regulated by a ventilation slide, which is also protected against fired projectiles by a security member arranged at a distance away from this ventilation slide. The appropriate overlapping of the security members in the area surrounding the ventilation slide also does not expose any areas to penetration by fired projectiles.

BRIEF DESCRIPTION OF THE DRAWINGS

In order that the invention may be clearly understood, it will now be described by way of four example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
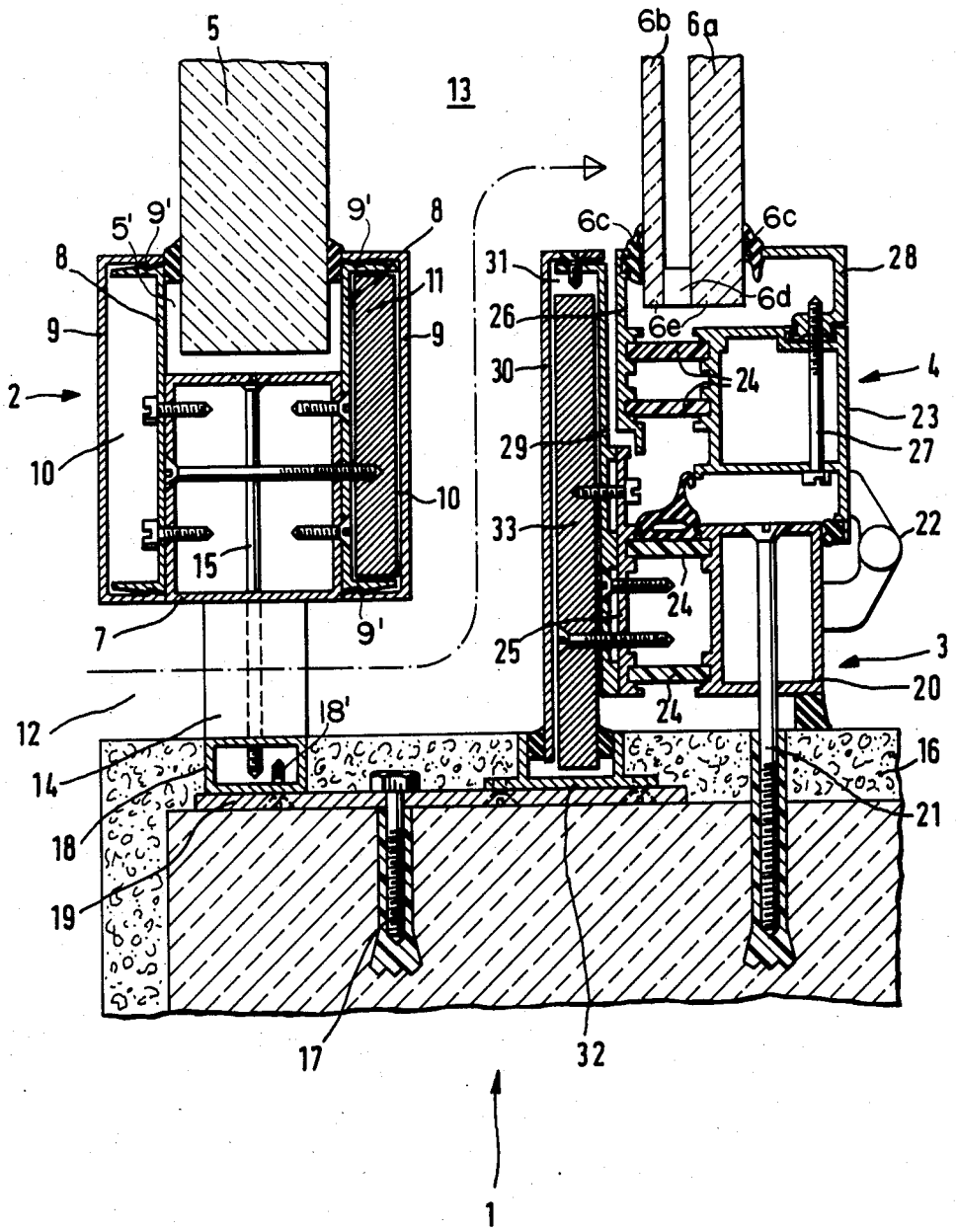
FIG. 1 is a cross-section through the edge area of a security window having two frames each with a security member and each enclosing a plate-like panel.

FIG. 1 shows two rigid frames 2 and 3 secured to the edge face of a soffit 1 of a structural opening in a wall. A movable window sash 4 is arranged within the rigid frame 3, to enclose a plate-like panel 6 while the rigid frame 2 encloses a plate-like panel 5. The panels 5 and 6 are held in a parallel, spaced arrangement to provide a spacing or space 13 between the panels.

The outer panel 5 of which one surface faces the attack susceptible outer side of the building or structure, may be a bullet-proof glazing, whereas the inner panel of which one surface faces the non-attack susceptible inside of the building or structure, comprises two glazing units or panel members 6*a* and 6*b* for example, for insulation purposes. The inner panel 6*a* of these panel members, i.e., the one facing the inside of the building may be a shatter-proof or breakage resistant, bullet-proof glazing unit, as would be desirable or even required, for example, for correctional institutions, banks, police stations and similar endangered or attack susceptible buildings or structures.

As shown in FIG. 1, the frame 2 comprises a hollow rectangular section carrying member 7 to each side of which a U-section member 8 is attached at the inner and outer surface. Another U-section member 9 is clipped at 9′ onto the protruding shanks of each of the U-section members 8, thereby forming two chambers 10 which laterally and vertically cover both the rectangular member 7 and the edge region 5′ of the panel 5. A security member 11 such as an armor, bullet-proof material is arranged to essentially fill the volume of at least one of the chambers 10, preferably the one which faces away from the attack susceptible side, that is the inner chamber 10.

The frame 2 is spaced from the soffit 1, whereby an opening gap 12 is formed bordered by the frame 2 and the soffit 1 all around the opening. The gap 12 connects the outside space on the attack susceptible side of the frame 2 with the chamber or space 13 formed between the two plate-like panels 5 and 6*b*. Sectional blocks 14 are arranged at certain spacings to bridge the gap 12 all around the soffit 1. Screws 15 pass through the blocks 14 to achieve a secure attachment of the frame 2 to the soffit 1. For this purpose the screws 15 penetrate the rectangular hollow sectional member 7, preferably in the plane of the panel 5, and the respective sectional block 14. The screws 15 are screwed into a sectional member 18 which is let into a finish layer 16 of the soffit 1. The sectional member 18 is connected with screws 18 to a flat stock member 19 which is anchored securely to the soffit 1 by screws 17.

The frame 3 also essentially comprises a hollow rectangular section member 20 which is connected to the soffit 1 by screws 21 extending in the plane of the panel 6*a* or in parallel thereto. A hinge strap 22 connects the frame 3 with the window sash 4 also constructed essentially of a hollow rectangular sectional member 23.

On the side facing the chamber or space 13, sectional cover members 25 and 26 extending in the plane of the panel 6, are mounted on spacer members 24 which extend perpendicularly to the plane of the panel 6 from the hollow rectangular sectional members 20 and 23, to complete the frames 3 and 4. The spacer members 24 are of a material having a low thermal conductivity, so as to interrupt any thermal bridging effect. A plurality of conventional elastic sealing or insulating strips are located as shown.

An angle section member 28 forming a cover is secured by screws 27 to the hollow rectangular sectional member 23 on the side of the panel 6 opposite of the sectional cover member 26, the latter being held in place by a snap fit. An upwardly extending flange of the cover member 26 and the angle sectional member 28 form a groove for receiving the edge or rim of the panel 6*a*, 6*b* between insulating strips 6*c*. A spacer 6*d* keeps the panels 6*a* and 6*b* spaced.

An angle section member 29 is screwed to the cover member 25 on the side facing the space 13. A further angle section member 30 which is essentially a mirror image of the angle section member 29, is screwed to this angle section member 29 to form a chamber 31. A lower edge of the angle section member 30 extending in parallel to the plane of the panel 6, reaches into a U-rail 32 set into the finish layer 16 of the soffit 1. A security, armored member 33 which essentially fills the chamber 31, also reaches into the U-rail 32 and extends through the chamber 31 at least to the edge area 6*e* of the panels 6*a* and 6*b*, whereby the security member 33 covers the cross section of the opening gaps 12 around the frames and both frames 3 and 4 as protection against a fired projectile or bullet.

Figure 2:
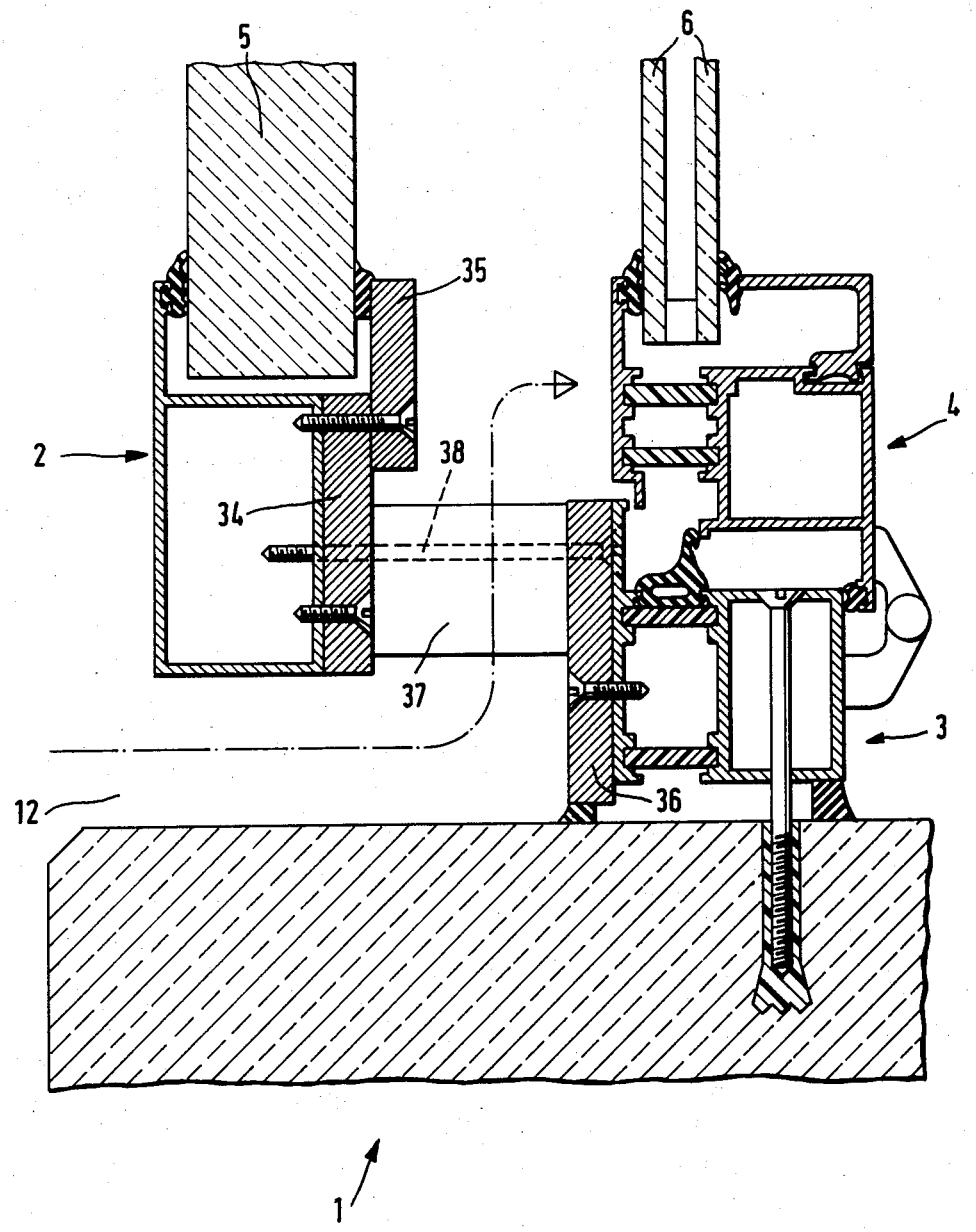
FIG. 2 is a cross-sectional view similar to FIG. 1, however, one of the security members is made up of two separate security member components, and the outer frame is secured in a different manner as compared to FIG. 1.

The embodiment of FIG. 2 differs from the above described embodiment according to FIG. 1 primarily in that the security member 11 is replaced by two security member components 34 and 35. The two components 34 and 35 overlap each other and are arranged so that the security component 35 serves as a glazing molding strip for the panel 5. Furthermore, a security member 36 attached to the frame 3 essentially only extends over the area of the frame 3 and leaves the major portion of the window sash 4 uncovered. However, the security component 35 protects the area of the sash 4. Finally, the security member components 34 and 35, and the security member 36 are not arranged in chambers, but are simply secured to the corresponding frame members. Instead of the sectional spacer blocks 14 arranged in the panel plane as shown in FIG. 1, sectional spacer blocks 37 are arranged to extend perpendicularly to the panel plane between the security member component 34 and the security member 36. Screws 38 pass through the security member component 34 and the security member 36 and through the respective spacer block 37, for achieving a sufficiently rigid connection of the frame 2 to the frame 3 so that the frame 2 with its panel 5 is held at a distance away from the soffit 1 to form the gap 12.

Figure 3:
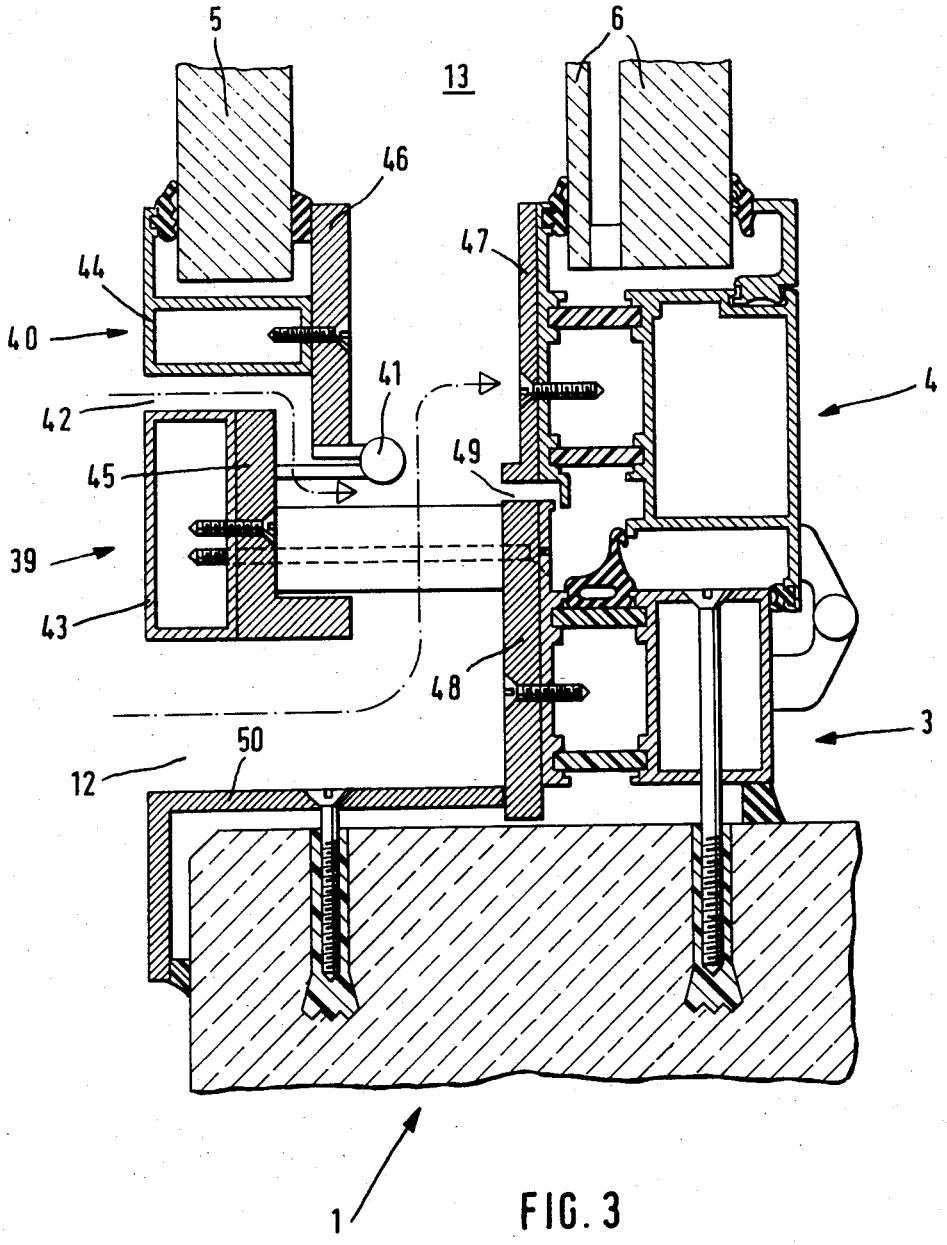
FIG. 3 is a cross-section through two frames each carrying a panel, whereby each frame comprises a blind frame and a window sash, and each frame part is protected by a separate security member.

In the embodiment shown in FIG. 3, a rigid frame 39 takes the place of the rigid frame 2 shown in the embodiments of FIGS. 1 and 2. A window sash 40 is arranged on the rigid frame 39 to receive the panel 5. The frame members 39 and 40 are connected to each other by means of a hinge strap 41 in a manner such that an additional opening gap 42 is formed between the frame members 39 and 40. The frame 39 comprises primarily a hollow rectangular sectional member 43 which is covered by a security member 45 on its side facing the space 13, while the sash 40 essentially comprises a hollow rectangular sectional member 44 which is covered by a security member 46 on its side facing the space 13. The security members 45 and 46 overlap each other and thereby also cover the additional opening gap 42. The security member 45 is an angle sectional member, i.e. has an L-shaped cross-section, and is arranged so that one shank of the member 45 extends perpendicularly to the panel plane into the space 13. Due to this arrangement, it is impossible even for a projectile fired at a very sharp angle with respect to the panel plane, which may have entered into the opening gap 12, to completely penetrate through the security window.

The frames 3 and 4 are covered on the side facing the space 13, by security members 48 and 47 respectively, which are arranged substantially in the same plane. A gap 49 between the security members 47 and 48 may be allowed without danger, since this gap 49 is not accessible to a projectile due to the arrangement of the other security members 45 and 46. An angle section security member 50 adjacent to the security member 48 increases the security or protection against the crosswise firing of projectiles at a steep angle. This security member 50 covers the soffit 1 including its edge area, on the side of the building or structure which is susceptible to attack.

Figure 4:
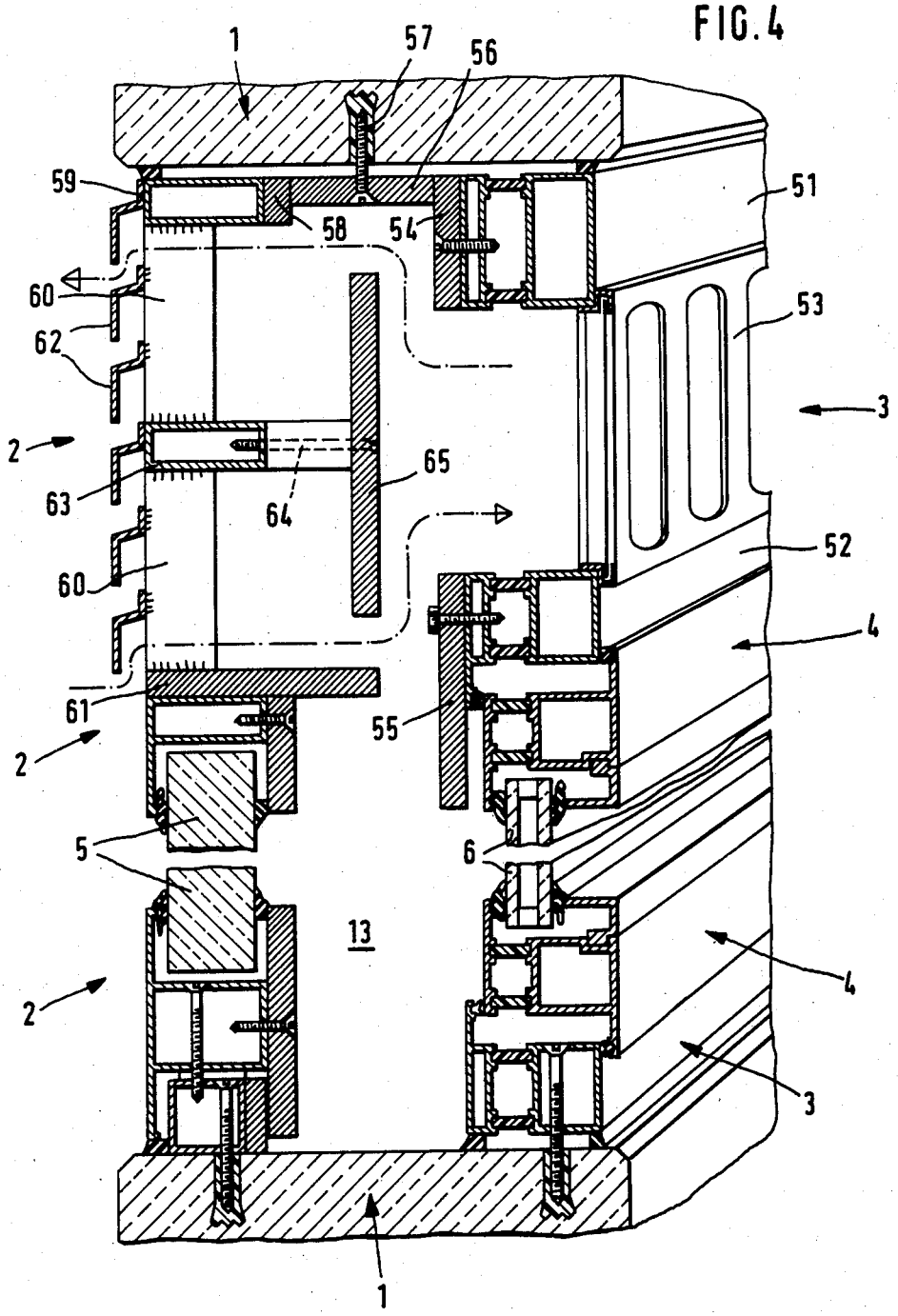
FIG. 4 is a cross-sectional perspective view through two frames, each enclosing a panel, whereby the shank of one frame is divided lengthwise by a ventilation slide.

In the embodiment according to FIG. 4 the panels 5 and 6 are again enclosed by frames 2 and 4 respectively, which comprise essentially box-shaped sectional frame members. The movable frame or sash 4, which pivots on a hinge strap, which is not shown, is connected by means of this hinge strap to a rigidly mounted frame 3. The horizontal upper shank of the frame 3 is divided lengthwise into two shank halves 51 and 52 which enclose a ventilation slide 53. The shank halves 51 and 52 are covered on the side facing the space 13, by security members 54 and 55 respectively. The security member 55 simultaneously covers the neighboring shank of the sash 4. A security member 56 which extends across a portion of the soffit 1 and is located adjacent to the abutting security member 54, is connected to the soffit 1 by screws 57. A further security member 58 connects the security member 56 to a carrying member 59, which is connected by spacer members 60 with another security member 61. This security member 61 which is arranged perpendicularly to the panel plane, is attached to the frame 2 of the panel 5, and limits the opening gap 12. The other side of the gap 12 is bounded by the carrier member 59 and the security member 58.

Louvre fins or ribs 62 spaced at an equal spacing from each other extend across the opening gap 12 on its attack susceptible side. The ribs 62 form a weather protective device which does not considerably hinder the free circulation of air. A girder 63 extends across the opening gap 12 and divides this gap 12 into two separate areas. A security member 65 is attached to this girder 63 by screws 64, whereby the security member 65 extends in parallel to the panel plane and is spaced a distance away from the ventilation slide 53. The edges of the security member 65 overlap the edges of the security members 54 and 55 which face or border the ventilation slide 53.

The arrangement of the security members made of a bullet-proof material such as steel, according to the invention, makes it possible to provide opening gaps of sufficient size for ventilation in windows as described in the example embodiments, without impairing the security of the window against explosions or projectiles fired at any firing angle.

Although the invention has been described with reference to specific example embodiments, it is to be understood that it is intended to cover all modifications and equivalents within the scope of the appended claims.

What I claim is:

1. A security structure for protecting an opening in a building, comprising at least a first plate-like panel on an attack susceptible or outer side of said window, and a second plate-like panel arranged parallel to and a distance away from said first panel on an inner side of said window away from said attack susceptible side to enclose a space between said first panel and second panel, a first frame comprising separate first frame sections for enclosing said first panel, a second frame comprising second frame sections for enclosing said second panel, whereby said first panel and said second panel are mounted with their respective frames within a soffit surrounding said opening, and at least one of said first frame sections is held a distance away from said soffit to form a gap which provides a venting flow connection between said space between said first panel and said second panel with the outside of said window, said structure further comprising a first security member of a bullet-proof material, and a similar second security member also of a bulletproof material, whereby said first security member is attached to said first frame on a side facing said second frame, and said second security member is attached to said second frame on a side facing said first frame, whereby at least one of said security members overlaps edge areas of one of said panels, and at least one other of said security members overlaps the area of said gap, and wherein said first and second security members partially overlap each other in the vertical direction.

2. The security structure of claim 1, wherein said first security member comprises two first security components, whereby one first security component is directly attached to and covers said first frame sections, and wherein the other first security component is attached to and overlaps said first security component, said other first security component extending over edge areas of said first panel to form a glazing molding strip.

3. The security structure of claim 1, further comprising spacer blocks distributed around the length of said first frame sections, and means connecting said first security member to said second security member through said spacer blocks.

4. The security structure of claim 1, wherein one of said first frame and second frame comprises a movable sash and a rigid blind frame, and the corresponding one of said first security member or said second security member comprises separate overlapping security member sections covering said sash and said blind frame, whereby any gap between said separate overlapping security members is covered by the other of said first security member or said second security member of said first frame or of said second frame.

5. The security structure of claim 1, further comprising an additional angle-section security member attached to said soffit to cover and protect said soffit and a soffit edge area, whereby said additional angle-section security member is so located that it adjoins or abuts said second security member to form a substantially Z-crosssectional configuration.

6. The security structure of claim 1, wherein said first frame is a rigid frame and said second frame is a movable frame comprising a ventilation slide and two lengthwise frame sections separated lengthwise by said ventilation slide, and wherein said second security member comprises two separate security member sections for covering and protecting said two lengthwise frame shanks, said structure further comprising an additional security member for covering the ventilation opening between said two separate security member sections, whereby said additional security member overlaps edges of said two separate security member sections which border said ventilation opening.

* * * * *